US010208720B2

(12) United States Patent
Tachikawa

(10) Patent No.: US 10,208,720 B2
(45) Date of Patent: Feb. 19, 2019

(54) INTAKE MANIFOLD

(71) Applicant: MAHLE FILTER SYSTEMS JAPAN CORPORATION, Tokyo (JP)

(72) Inventor: Noritaka Tachikawa, Fujimino (JP)

(73) Assignee: MAHLE FILTER SYSTEMS JAPAN CORPORATION, Tokyo (JP)

( * ) Notice: Subject to any disclaimer, the term of this patent is extended or adjusted under 35 U.S.C. 154(b) by 3 days.

(21) Appl. No.: 15/349,171

(22) Filed: Nov. 11, 2016

(65) Prior Publication Data

US 2017/0167452 A1 Jun. 15, 2017

(30) Foreign Application Priority Data

Dec. 15, 2015 (JP) ..... 2015-243783

(51) Int. Cl.

| | |
|---|---|
| ***F02M 35/00*** | (2006.01) |
| ***F02M 35/10*** | (2006.01) |
| ***F02M 35/104*** | (2006.01) |
| *F02M 26/17* | (2016.01) |

(52) U.S. Cl.

CPC ..... *F02M 35/1036* (2013.01); *F02M 35/104* (2013.01); *F02M 35/10052* (2013.01); *F02M 35/10222* (2013.01); *F02M 35/10229* (2013.01); *F02M 35/10321* (2013.01); (Continued)

(58) Field of Classification Search

CPC ..... F02M 35/1036; F02M 35/10052; F02M 35/10222; F02M 35/10229; F02M 26/17

See application file for complete search history.

(56) References Cited

U.S. PATENT DOCUMENTS

| | | | |
|---|---|---|---|
| 7,082,915 | B2 | 8/2006 | Tanikawa et al. |
| 7,131,415 | B2 | 11/2006 | Enokida et al. |
| 2006/0005820 | A1 | 1/2006 | Jeon |

FOREIGN PATENT DOCUMENTS

| | | | | |
|---|---|---|---|---|
| DE | 10 2005-036 104 | A1 | 2/2006 | |
| DE | 10 2012 024 535 | A1 | 6/2013 | |
| DE | 102012208841 | A1 * | 12/2016 | ..... B29C 45/4435 |

(Continued)

OTHER PUBLICATIONS

Extended European Search Report, dated Jan. 25, 2017, 7 pages.
European Office Action, Application No. 16 198 304.4, dated May 31, 2018, 5 pages.

*Primary Examiner* — Kevin A Lathers
(74) *Attorney, Agent, or Firm* — Foley & Lardner LLP

(57) ABSTRACT

An intake manifold made of synthetic resin includes first, second and third members stacked in sequence and welded to form the intake manifold; a collector extending inside the intake manifold in a direction of a line of cylinders, a part of wall of the collector being formed by the third member; a plurality of branch passages formed substantially by the first and second members and wound around an outer periphery of the collector; and a connector passage leading from the collector to an outer peripheral side of the branch passage. The first, second and third members are respectively provided with first, second and third cylinder portions that are coaxially arranged with each other in a position between adjacent two branch passages. The connector passage is formed by the first, second and third cylinder portions with the connector passage communicating with an inside space of the collector.

5 Claims, 7 Drawing Sheets

(52) U.S. Cl.
CPC ..... *F02M 26/17* (2016.02); *F02M 35/10236* (2013.01); *F02M 35/10347* (2013.01)

(56) References Cited

FOREIGN PATENT DOCUMENTS

| | | | |
|---|---|---|---|
| JP | 2008-106628 | A | 5/2008 |
| JP | 2009-221859 | A | 10/2009 |
| JP | 2013-249732 | A | 12/2013 |
| JP | 2015-48814 | A | 3/2015 |

* cited by examiner

INTAKE MANIFOLD

BACKGROUND OF THE INVENTION

The present invention relates to an intake manifold having a structure in which branch passages are wound around a collector, for an internal combustion engine, and more particularly to an intake manifold formed as an integral unit by vibration-welding a plurality of synthetic resin-made members.

As disclosed in Japanese Unexamined Patent Publications No. 2008-106628 (hereinafter is referred to as "JP2008-106628") and No. 2015-048814 (hereinafter is referred to as "JP2015-048814"), there has been known an intake manifold (called a branch passage-winding-type intake manifold) having a structure in which a plurality of branch passages are formed so as to wind around an outer periphery of a collector that extends along a direction of a line of cylinders. Such type of intake manifolds have been proposed and developed to secure a long length of the branch passage in limited outer dimensions of the intake manifold. As disclosed in these publications, as a typical manner of producing the intake manifold, a plurality of synthetic resin-made members partly forming the collector and the branch passages etc. are combined and joined or fixed together by vibration-welding.

The collector of the intake manifold could be provided with a connector passage for connecting the collector and an external pipe, for instance, for taking out a negative pressure from an inside of the collector or for introducing a certain gas (such as an EGR gas and a blowby gas) into the collector.

Japanese Unexamined Patent Publication No. 2013-249732 (hereinafter is referred to as "JP2013-249732") has disclosed a synthetic resin-made intake manifold having a structure in which a plurality of branch passages extend from a collector to a side of the collector, and also disclosed that a connector passage is formed along a mating surface of two synthetic resin-made members that are welded together. More specifically, the connector passage is not connected to a collector body part that is covered or wound with the branch passages, but connected to an inlet port of a collector end portion that is not covered or overlapped with the branch passages.

SUMMARY OF THE INVENTION

In the branch passage-winding-type intake manifold disclosed in JP2008-106628 and JP2015-048814, however, since the plurality of branch passages are arranged so as to wind around an outside of the collector, it is difficult to form the connector passage connecting the inside of the collector and the external pipe.

Further, in a configuration or structure, like JP2013-249732, in which the connector passage is formed along the mating surface of the two synthetic resin-made members, an arrangement position of the connector passage is limited to the inlet port of the collector end portion, and further, the connector passage cannot be pulled out in a direction crossing the branch passages.

An object of the present invention is therefore to provide an intake manifold that is capable of easily forming the connector passage connecting the inside of the collector and the external pipe.

According to one aspect of the present invention, an intake manifold made of synthetic resin, comprises: first, second and third members stacked in sequence and welded to form the intake manifold; a collector extending inside the intake manifold in a direction of a line of cylinders, a part of wall of the collector being formed by the third member; a plurality of branch passages formed substantially by the first and second members and wound around an outer periphery of the collector; and a connector passage leading from the collector to an outer peripheral side of the branch passage. And, the first, second and third members are provided with first, second and third cylinder portions respectively, and the first, second and third cylinder portions are coaxially arranged with each other in a position between adjacent two branch passages. A first welding portion is formed in a boundary between the first and second members so as to encircle the first and second cylinder portions, and a second welding portion is formed in a boundary between the second and third members so as to encircle the second and third cylinder portions. And, the connector passage is formed by the first, second and third cylinder portions with the connector passage communicating with an inside space of the collector.

That is, the first cylinder portion formed in the first member, the second cylinder portion formed in the second member and the third cylinder portion formed in the third member are coaxially arranged with each other, thereby forming the connector passage whose one end communicates with the inside space, a part of which is formed by the third member, of the collector. A boundary between the first and second cylinder portions is encircled and externally sealed with the first welding portion formed between the first and second members. Likewise, a boundary between the second and third cylinder portions is encircled and externally sealed with the second welding portion formed between the second and third members.

As one preferable aspect of the present invention, a part of the first welding portion located between the first and second members and encircling the first and second cylinder portions is formed by a branch passage-forming welding portion that is shaped along side edges of the adjacent two branch passages located at both sides of the first and second cylinder portions.

That is, since the plurality of branch passages are formed into the respective passage shapes, the branch passage-forming welding portion shaped along side edges of the adjacent two branch passages is provided between the first and second members. A part of the first welding portion encircling the cylinder portions is formed by using this branch passage-forming welding portion.

As one preferable aspect of the present invention, a boundary position between the first cylinder portion of the first member and the second cylinder portion of the second member is offset in an axial direction of the first and second cylinder portions from the first welding portion, and a space is created between outer peripheral surfaces of the first and second cylinder portions and the first welding portion. Therefore, burrs (i.e. resin material liquefied by welding) arising at the welding portion in a welding process is kept or stored in the space, thereby preventing a cross-sectional area of the connector passage from narrowing due to entry of the burrs into the boundary between the first cylinder portion and the second cylinder portion.

According to the present invention, only by welding the three members together, the connector passage extending from the inside space of the collector to the outside can be formed. In particular, it is possible to obtain the connector passage extending from the collector to the outer peripheral side of the branch passage so as to cross the branch passage between the two branch passages.

The other objects and features of this invention will become understood from the following description with reference to the accompanying drawings.

DETAILED DESCRIPTION OF THE INVENTION

Embodiments of the present invention will be explained below with reference to the drawings.

Figure 1:
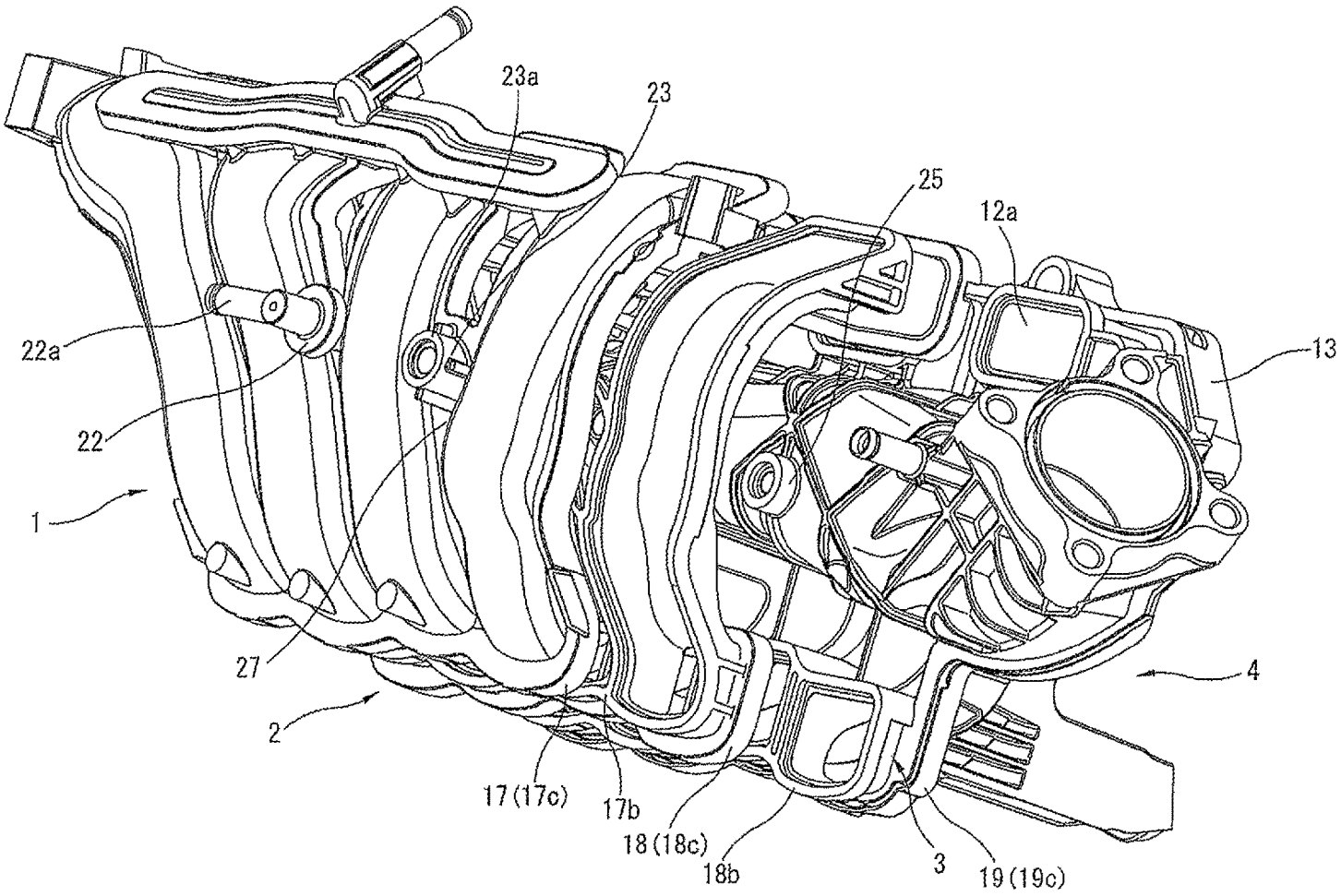
FIG. 1 is a perspective exploded view of an intake manifold according to an embodiment of the present invention.
Figure 2:
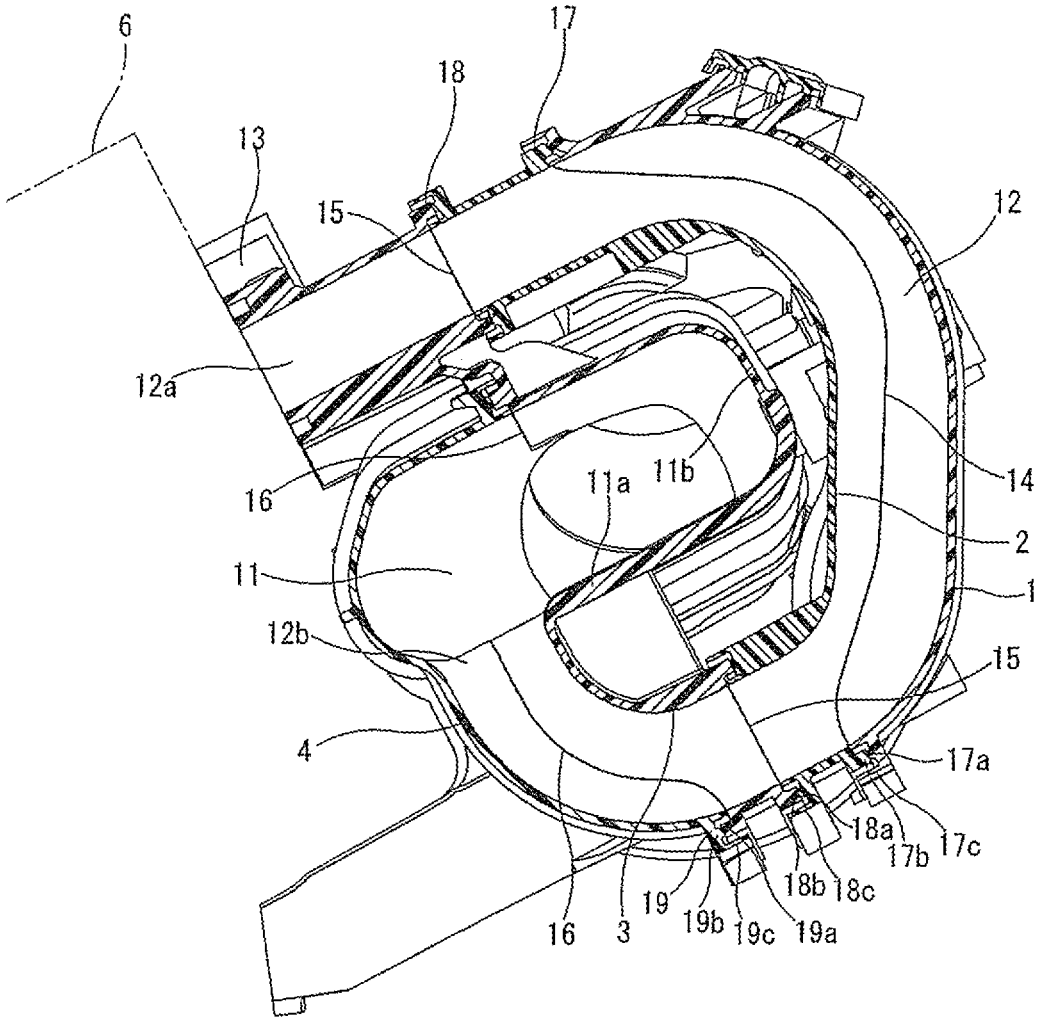
FIG. 2 is a sectional view of the intake manifold, taken along an A-A line of FIG. 7.

The present embodiment is an embodiment to which the present invention is applied as an intake manifold for an in-line four-cylinder engine. As shown in FIGS. 1 and 2, the intake manifold is formed substantially by four members of a first member 1, a second member 2, a third member 3 and a fourth member 4. Each of these members is formed into a predetermined shape with thermoplastic synthetic resin, e.g. nylon (registered trade mark) resin in which glass fiber is mixed, by injection molding. These members are combined and joined (connected) together by vibration-welding, then the intake manifold is formed as an integral unit. More specifically, the first member 1 is connected to one side (one surface) of the second member 2. The other side (the other surface) of the second member 2 is connected to one side (one surface) of the third member 3. The other side (the other surface) of the third member 3 is connected to the fourth member 4. That is, the four members 1, 2, 3 and 4 are welded in sequence. Here, an expression "in sequence" does not mean an order of welding process. In the present invention, the welding order of the four members 1, 2, 3 and 4 is arbitrary.

FIG. 2 is a sectional view of the intake manifold, cut along a direction orthogonal to a direction of a line of cylinders in an assembly state (i.e. a completed product state) of the intake manifold. This FIG. 2 corresponds to an attitude of a vehicle mount state in which the intake manifold is mounted on a cylinder head 6 side surface of an internal combustion engine. As shown in FIG. 2, the intake manifold has a hollow narrow collector 11 that extends along the direction of the line of the cylinders and four branch passages 12 that are wound around an outer periphery of the collector 11 throughout an almost entire circumference of the collector 11 except for a surface of the collector 11 at an engine side. The branch passage 12 opens as an opening portion 12*a* at a base end of the branch passage 12, which is fixed to the cylinder head 6 at an upper side of the collector 11. A top end of the branch passage 12, as a communication port 12*b*, is connected to a bottom wall 11*a* of the collector 11 at an engine side.

Figure 6:
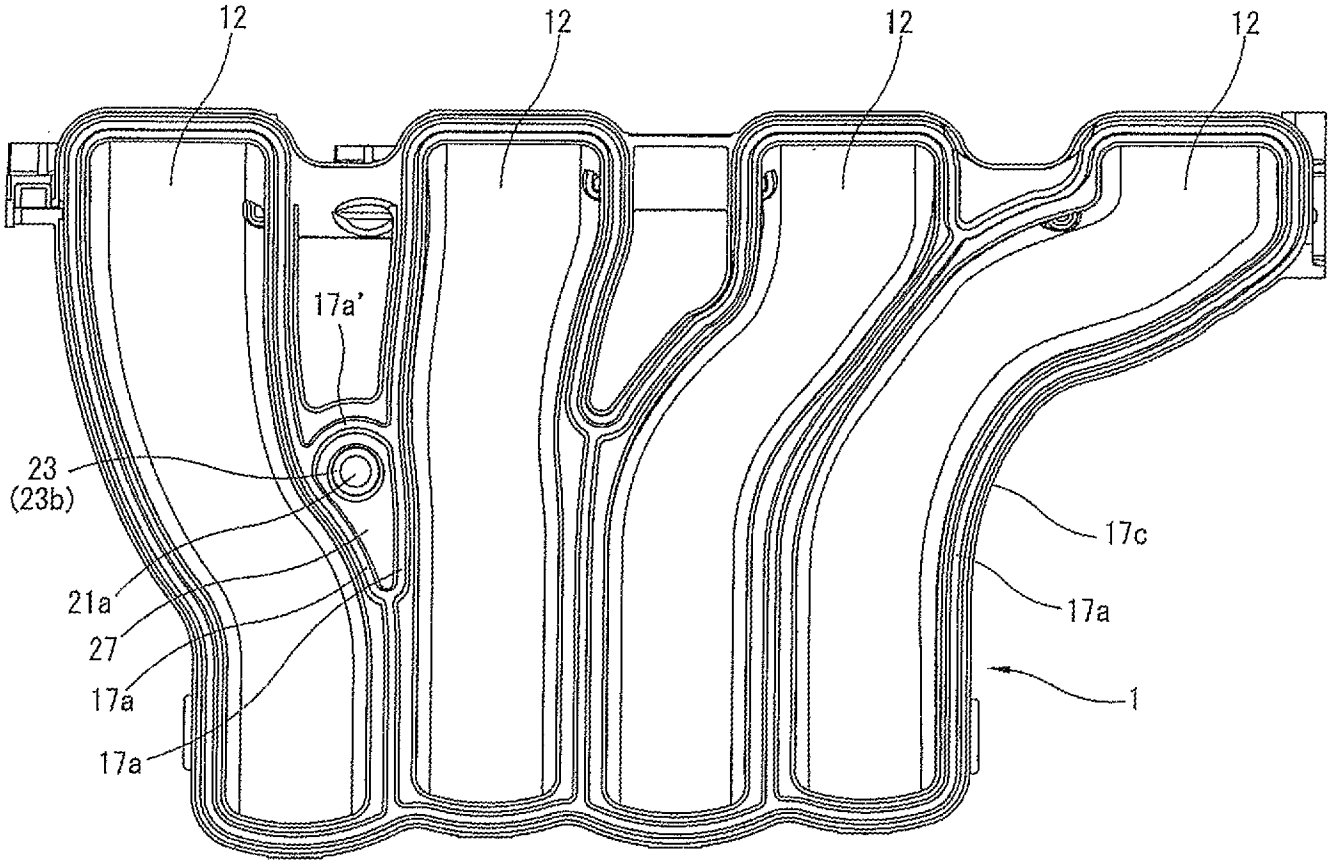
FIG. 6 is a plane figure showing a surface of a first member, which faces a second member.
Figure 7:
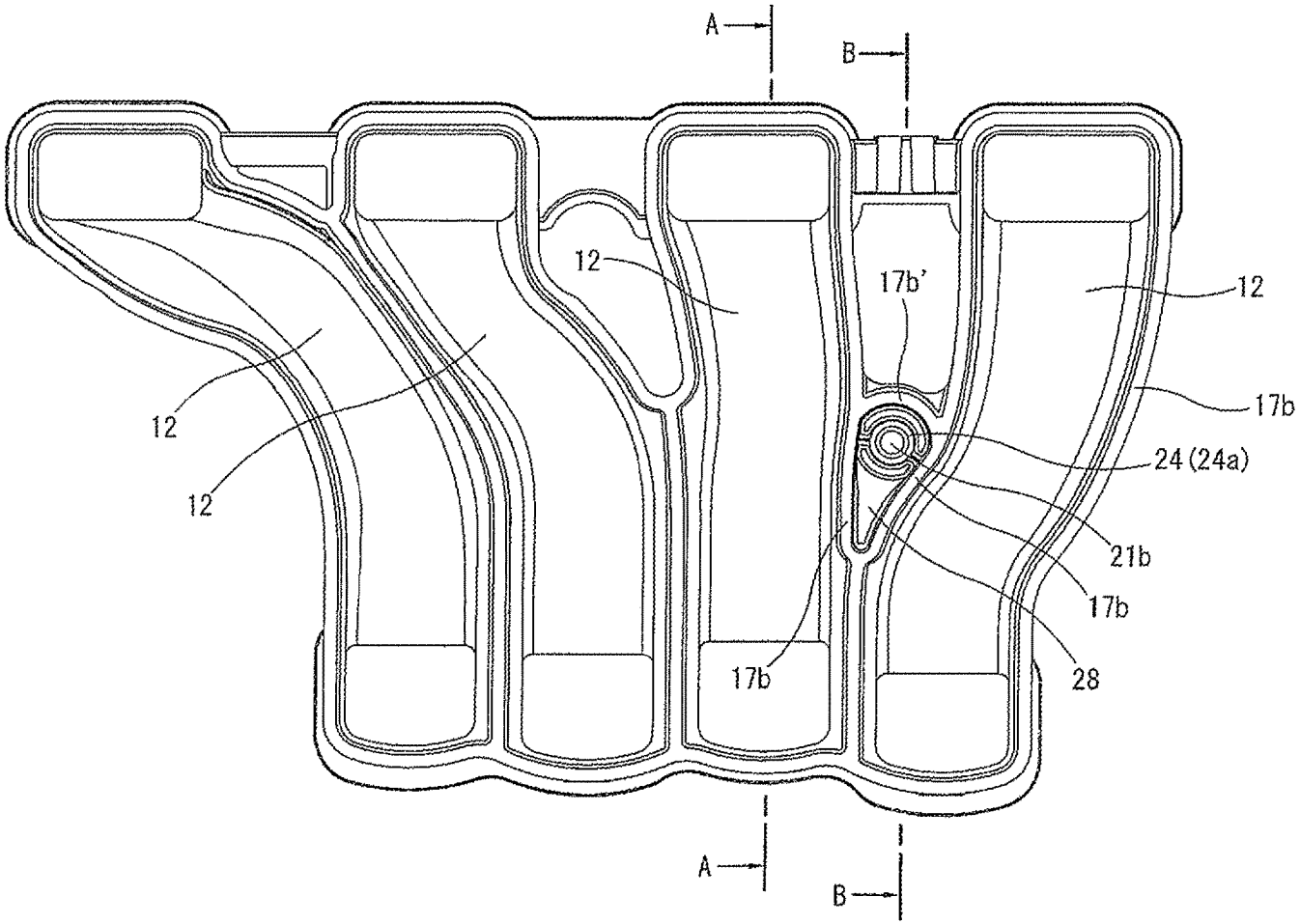
FIG. 7 is a plane figure showing a surface of the second member, which faces the first member.

Here, although FIG. 2 shows the branch passage 12 for #2-cylinder of the four branch passages 12 of the in-line four-cylinder engine, the other three branch passages 12 also have a substantially same cross section, cut along a direction orthogonal to the direction of the line of the cylinders. As shown in FIGS. 6 and 7, when viewed from a side of the engine, the branch passage 12 for #2-cylinder substantially extends straight, whereas the other three branch passages 12 for #1, #3 and #4-cylinders extend so that their cylinder head 6 side portions bend and expand in the direction of the line of the cylinders.

As shown in FIGS. 1 and 2, the collector 11 is formed by connecting the third member 3 and the fourth member 4, together with a part of the top end side of the branch passage 12. A major section of the branch passage 12, which has a curved shape, is formed by connecting the first member 1 and the second member 2. Then, the second member 2 and the third member 3 are connected so that the top end side portion of the branch passage 12 and the major section of the branch passage 12 communicate with each other. In FIG. 2, a reference sign 14 denotes a separation surface or a split surface (in other words, a mating surface or a connecting surface) of the first member 1 and the second member 2. A reference sign 15 denotes a split surface (a mating surface) of the second member 2 and the third member 3. A reference sign 16 denotes a split surface (a mating surface) of the third member 3 and the fourth member 4. These split surfaces (mating surfaces) 14, 15 and 16 are formed as surfaces parallel to a predetermined vibration direction when performing the vibration-welding, as is obvious to a person having ordinary skill in the art. As shown in FIG. 2 (also, in FIGS. 1, 3 and 4), the opening portion 12*a* of the branch passage 12 is shaped into a rectangular frame or a rectangular cylindrical shape by the third member 3. Further, a mounting flange 13 for mounting the whole intake manifold on the cylinder head 6 is formed integrally with the third member 3 together with this opening portion 12*a*.

Welding protrusions that form welding portions 17, 18 and 19 are provided at the members 1 to 4 along the split surfaces 14, 15 and 16. More specifically, the welding portion 17 between the first member 1 and the second member 2 is formed by butting a welding protrusion 17*a* of the first member 1 side and a welding protrusion 17*b* of the second member 2 side together and by performing the vibration-welding of the both welding protrusions 17*a* and 17*b*. Each of these welding protrusions 17*a* and 17*b* is formed as a protruding line that is one extending line enclosing the split surface 14, as is obvious to a person having ordinary skill in the art. And also, the welding protrusions 17*a* and 17*b* are arranged so as to face to each other. Further, a thin burr storing rib 17*c* is provided as necessary so as to suppress a flow of burrs caused by molten resin material. Likewise, the welding portion 18 between the second member 2 and the third member 3 is formed by a welding protrusion 18*a* of the second member 2 side and a welding protrusion 18*b* of the third member 3 side, and has a burr storing rib 18*c*. The welding portion 19 between the third member 3 and the fourth member 4 is formed by a welding protrusion 19*a* of the third member 3 side and a welding protrusion 19*b* of the fourth member 4 side, and has a burr storing rib 19*c*.

With regard to the collector 11 having the split surface 16, basically, a section of the collector 11 at the cylinder head 6 side is formed by the fourth member 4, while an opposite side, i.e. a section of the collector 11, which is covered with the four branch passages 12, is formed by the third member 3. A side wall 11*b* of the collector 11 formed by the third member 3 and an outside surface (a surface facing to the collector 11) of the third member 3 forming the branch passage 12 are separate from each other. That is, between these side wall 11*b* and outside surface, a substantially U-shaped space in cross section as shown in FIG. 2 is provided.

Figure 3:
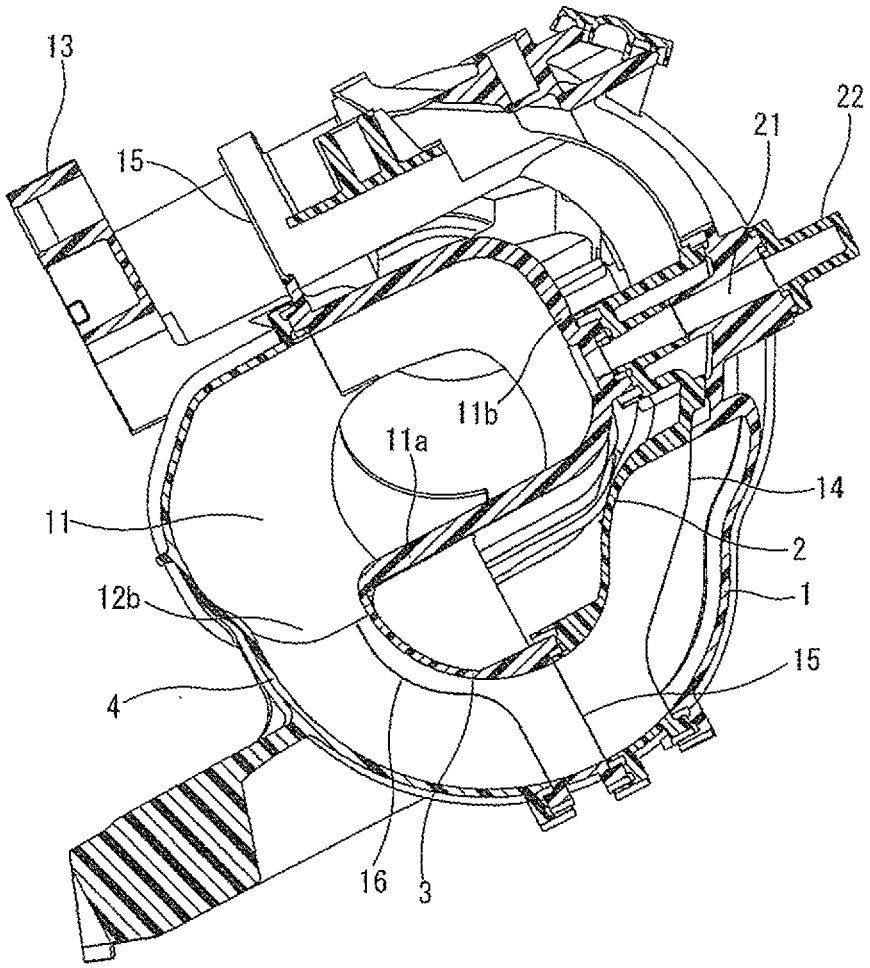
FIG. 3 is a sectional view of the intake manifold, taken along a B-B line of FIG. 7.
Figure 4:
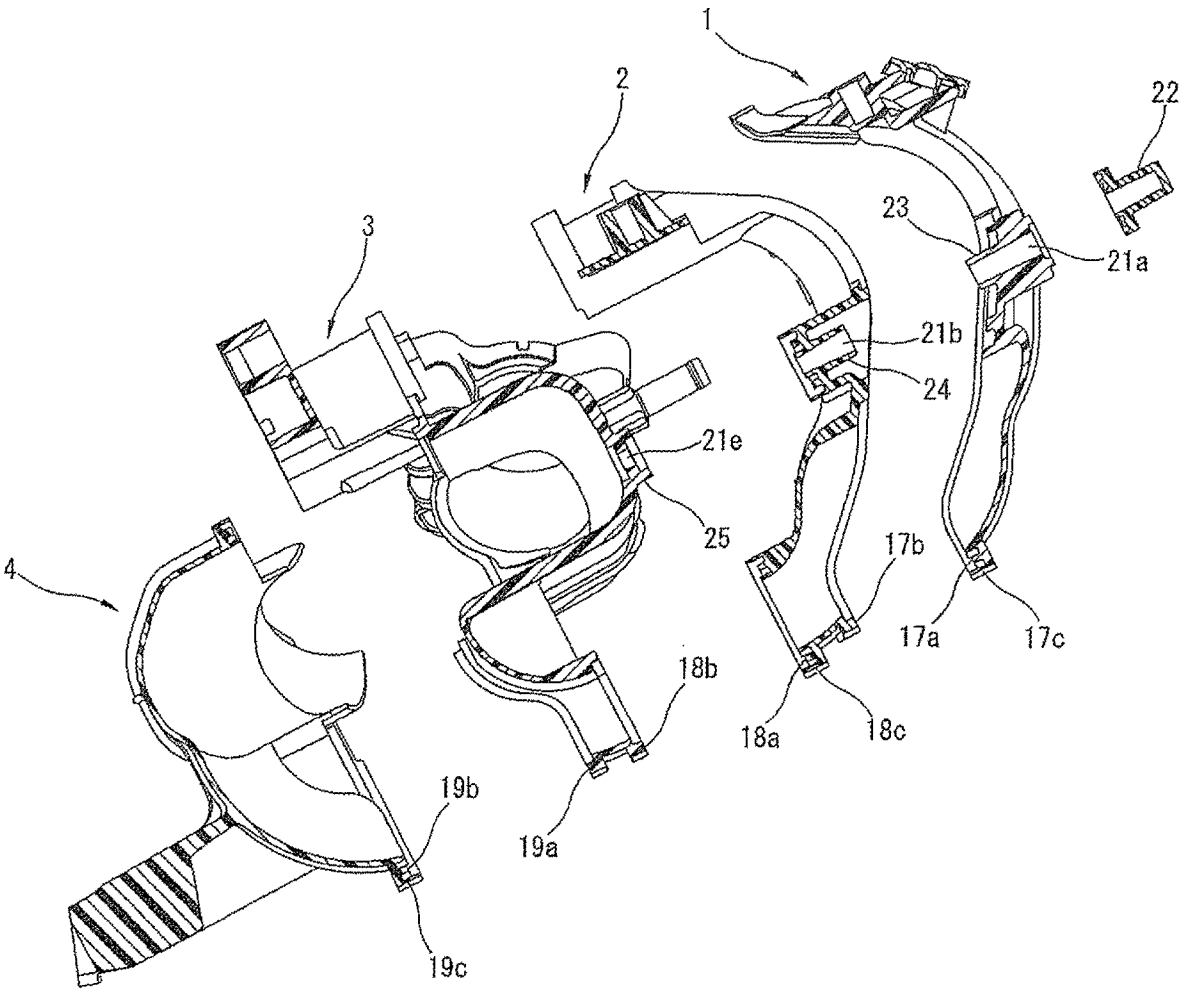
FIG. 4 is a sectional view, cut in the same surface as that of FIG. 3, with each member dismantled.
Figure 5:
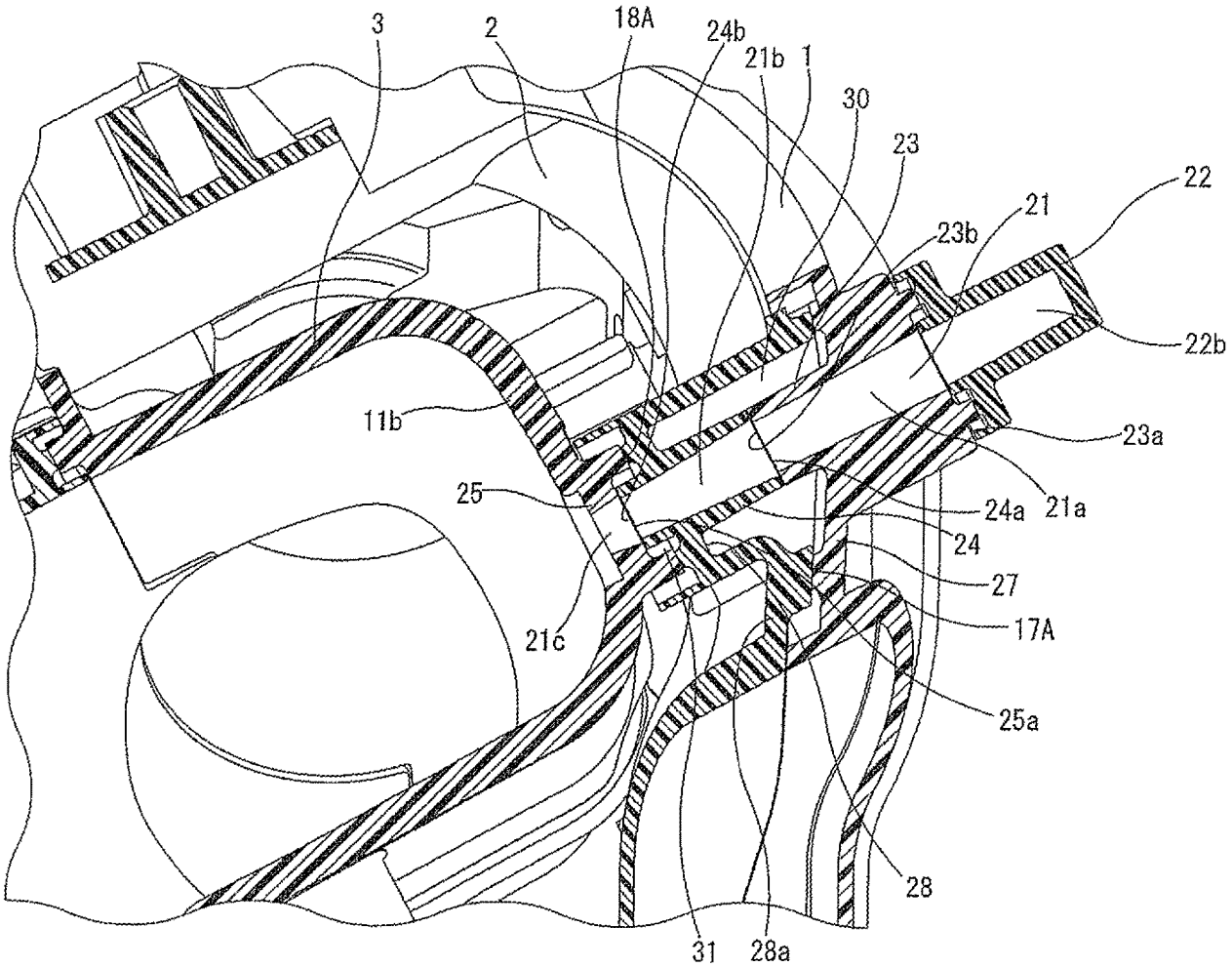
FIG. 5 is an enlarged view of FIG. 3.

FIGS. 3 to 5 show a configuration or structure of a connector passage 21 that is an essential part of the present invention. The connector passage 21 in this embodiment is a connector passage for taking out a negative pressure from an inside space of the collector 11. As shown in FIG. 1, the connector passage 21 is configured so that an external pipe (not shown) such as a rubber hose (not shown) is connected to a connector pipe 22*a* of an outermost connector member 22 that is connected to the the connector passage 21.

The connector passage 21 is disposed between the adjacent two branch passages 12, more specifically, between the branch passage 12 for #1-cylinder and the branch passage 12 for #2-cylinder (see FIGS. 6 and 7), and formed into a straight shape along a surface orthogonal to the direction of the line of the cylinders, i.e. along a cross section shown in FIG. 3 etc. As can be seen in FIGS. 4 and 5, the connector passage 21 is formed by connecting three cylinder portions of a first cylinder portion 23 formed integrally with the first member 1, a second cylinder portion 24 formed integrally with the second member 2 and a third cylinder portion 25 formed integrally with the third member 3 in series so as to communicate with each other.

More specifically, the first member 1 is provided with an almost triangle plate shape first inter-branch web 27 in an area between the branch passage 12 for #1-cylinder and the branch passage 12 for #2-cylinder where the connector passage 21 is disposed so as to connect side edges of the both branch passages 12 (see FIG. 6). And, the first cylinder portion 23 is formed integrally with the first member 1 with the first cylinder portion 23 penetrating this first inter-branch web 27. A top end side portion of the first cylinder portion 23 protrudes from the first inter-branch web 27 toward the collector 11. An opposite side portion of the first cylinder portion 23, i.e. a portion of the first cylinder portion 23 which protrudes from the first inter-branch web 27 to the outside, is shaped into a boss having a radially thick portion. An end surface of this boss acts as a seating surface 23*a*, and the connector member 22 that is molded as a single unit is welded to the seating surface 23*a* by the vibration-welding. Since the above-mentioned connector pipe 22*a* is formed on a side surface of the connector member 22, an L-shaped-bent passage 22*b* is formed in the connector member 22.

Likewise, as shown in FIG. 7, the second member 2 is provided with a second inter-branch web 28, which corresponds to the first inter-branch web 27, in an area between the two branch passages 12. And, the second cylinder portion 24 is formed integrally with the second member 2 with the second cylinder portion 24 penetrating this second inter-branch web 28. Here, most of an area of the second inter-branch web 28 sinks toward the collector 11, namely, that the second inter-branch web 28 has a bottomed cylindrical shape. The second cylinder portion 24 is then formed integrally with the second member 2 with the second cylinder portion 24 being orthogonal to a bottom wall 28*a* of the bottomed cylindrical shape of the second inter-branch web 28. A top end portion of the second cylinder portion 24 slightly protrudes from the bottom wall 28*a* toward the collector 11. An opposite side portion of the second cylinder portion 24, i.e. a base end portion of the second cylinder portion 24, protrudes relatively long from the bottom wall 28*a* toward the first cylinder portion 23. A tip end 23*b* of the first cylinder portion 23 and a base end 24*a* of the second cylinder portion 24 face to each other through an extremely slight gap or clearance when the vibration-welding has been completed. That is, a first connector passage 21*a* in the first cylinder portion 23 and a second connector passage 21*b* in the second cylinder portion 24 communicate with each other as substantially one passage.

The first inter-branch web 27 of the first member 1, the second inter-branch web 28 of the second member 2 and a part of the side wall 11*b* of the collector 11 by the third member 3 are stacked or arranged in layers (or overlapped with each other). The third cylinder portion 25 is formed integrally with the third member 3 in a position corresponding to the second cylinder portion 24. The third cylinder portion 25 is shaped into a circular boss that slightly protrudes from an outside surface of the side wall 11*b* of the collector 11 toward the second member 2. A tip end 24*b* of the second cylinder portion 24 and a base end 25*a* of the third cylinder portion 25 face to each other through an extremely slight gap or clearance when the vibration-welding has been completed. That is, the second connector passage 21*b* in the second cylinder portion 24 and a third connector passage 21*c* in the third cylinder portion 25 communicate with each other as substantially one passage. Here, in the drawing as an example, a length in an axial direction of the third cylinder portion 25 is set to a minimum length that is not a great difference from a thickness of the side wall 11*b*, and thus the third cylinder portion 25 is almost equivalent to a simple hole. However, the length in the axial direction of the third cylinder portion 25 could be set to be longer than that shown in the drawings.

As described above, in a state in which the vibration-welding of the members 1 to 4 as the intake manifold is completed, the three portions of the first connector passage 21*a* by the first cylinder portion 23, the second connector passage 21*b* by the second cylinder portion 24 and the third connector passage 21*c* by the third cylinder portion 25 are arranged in a straight line (coaxially arranged with each other), then these form the substantially one communicating connector passage 21. Here, basically, inside diameters of the first, second and third connector passages 21*a*, 21*b* and 21*c* are set to the same diameter. However, since draft required for dies-cutting upon the injection molding is given to the members, as shown in FIG. 5, a slight diameter difference might appear in each boundary.

A boundary between the tip end 23*b* of the first cylinder portion 23 and the base end 24*a* of the second cylinder portion 24 is sealed with a welding portion (a first welding portion) 17A provided between the first member 1 and the second member 2 so as to encircle these first and second cylinder portions 23 and 24. The welding portion 17A is a welding portion formed by butting the welding protrusion 17*a* of the first member 1 side and the welding protrusion 17*b* of the second member 2 side together and by performing the vibration-welding of the both welding protrusions 17*a* and 17*b*, which is the same manner as the other welding portion 17. The welding protrusions 17*a* and 17*b* are formed along outer edges of the first and second inter-branch web 27 and 28 respectively. More specifically, in the first member 1, as shown in FIG. 6, a part of the welding protrusion 17*a* for forming the branch passage, which is provided along the side edge of the branch passage 12 for #1-cylinder, and a part of the welding protrusion 17*a* for forming the branch passage, which is provided along the side edge of the branch passage 12 for #2-cylinder, are arranged so as to have a substantially V-shape. Then, an arc welding protrusion 17*a* (in FIG. 6, denoted by a reference sign 17*a*') is provided so as to unite the two welding protrusions 17*a* coaxially with the cylinder portion 23. Likewise, in the second member 2, as shown in FIG. 7, substantially V-shaped two welding protrusions 17*b* for forming the branch passage and an arc welding protrusion 17*b*' are formed into a shape corresponding to the welding protrusions 17*a* of the first member 1.

The welding portion 17A formed by the welding protrusions 17*a* and 17*b* is located, as a position along an axial direction of the cylinder portions 23, 24 and 25 when viewed as the cross section shown in FIG. 5, in a position that is equal to the welding portion 17 arranged at the side edge of the branch passage 12. Meanwhile, the boundary between the tip end 23*b* of the first cylinder portion 23 and the base end 24*a* of the second cylinder portion 24 is located in a position that protrudes toward the collector 11 side. That is, the boundary between the tip end 23*b* of the first cylinder portion 23 and the base end 24*a* of the second cylinder portion 24 is offset in the axial direction of the cylinder portions 23, 24 and 25 from the welding portion 17A encircling the first and second cylinder portions 23 and 24. Then, since the second inter-branch web 28 sinks, as the bottomed cylindrical shape, toward the collector 11, a space 30 having relatively large volume which encircles the above boundary is created between outer peripheral surfaces of the first and second cylinder portions 23 and 24 and the welding portion 17A (see FIG. 5). The above boundary is also offset in the axial direction of the cylinder portions 23, 24 and 25 from the recessed bottom wall 28*a* of the second inter-branch web 28. Consequently, the burrs (i.e. resin material liquefied by the welding) arising at the welding portion 17A in the welding process is kept or stored in the space 30, thereby preventing a cross-sectional area of the connector passage from narrowing due to entry of the burrs into the boundary between the first cylinder portion 23 and the second cylinder portion 24.

Likewise, a boundary between the tip end 24*b* of the second cylinder portion 24 and the base end 25*a* of the third cylinder portion 25 is sealed with a welding portion (a second welding portion) 18A provided between the second member 2 and the third member 3 so as to encircle these second and third cylinder portions 24 and 25. The welding portion 18A is a welding portion formed by butting the welding protrusion 18*a* of the second member 2 side and the welding protrusion 18*b* of the third member 3 side together and by performing the vibration-welding of the both welding protrusions 18*a* and 18*b*, which is the same manner as the other welding portion 18. These welding protrusions 18*a* and 18*b* are formed coaxially with each other slightly away from the outer peripheral surface of the second cylinder portion 24 in a radial direction of the connector passage 21. As mentioned above, the burr storing rib 18*c* is provided so as to further coaxially encircle an outer circumference of the welding portion 18A.

The welding portion 18A is slightly offset, when viewed as the cross section shown in FIG. 5, in the axial direction of the cylinder portions 23, 24 and 25 from the boundary between the tip end 24*b* of the second cylinder portion 24 and the base end 25*a* of the third cylinder portion 25. Then, between these welding portion 18A and the above boundary between the tip end 24*b* and the base end 25*a*, a space 31 having a relatively small volume for storing the burrs arising at the welding portion 18A is created.

As explained above, when forming the connector passage 21 communicating with the inside space of the collector 11, only by molding the cylinder portions 23, 24 and 25 integrally with the first, second and third members 1, 2 and 3 respectively then simply performing the vibration-welding of these members 1, 2 and 3, the connector passage 21 leading from the collector 11 to an outer peripheral side of the branch passage 12 can be obtained. Therefore, this does not require any sophisticated structure or configuration and any complicated process. In particular, it is possible to pull out the connector passage 21 to an opposite side to the cylinder head 6 with the connector passage 21 crossing the branch passage 12, and this increases flexibility in layout of the connector passage 21.

Further, a columnar reinforcing member, which connects the side wall 11*b* of the collector 11 to the second member 2 and the first member 1 that form the branch passage 12, is formed by the cylinder portions 23, 24 and 25 and the welding portions 17A and 18A located around the cylinder portions 23, 24 and 25. Therefore, it is possible to increase rigidity and strength of the side wall 11*b* to which a pressure difference between the negative pressure and an outside air pressure is applied, and this also increases rigidity and strength of the collector 11.

Although the present invention has been explained above, the present invention is not limited to the structure or configuration of the above embodiment. For instance, in the above embodiment, the intake manifold is formed by the four synthetic resin-made members. However, the intake manifold could be formed by some members, and for instance, even if the intake manifold is formed by three members or five members or more, the present invention can be applied to that intake manifold. Further, in the above embodiment, the branch passages are wound around the outer periphery of the collector throughout the almost entire circumference of the collector except for the surface of the collector at an engine side. However, even if the branch passages are wound around the outer periphery of the collector within a smaller angular range of the intake manifold, the present invention can be applied to that intake manifold. Moreover, as the connector passage, it is not limited to the connector passage for taking out the negative pressure which is described in the above embodiment, but it could be a connector passage that introduces an EGR gas or a blowby gas into the collector.

The entire contents of Japanese Patent Application No. 2015-243783 filed on Dec. 15, 2015 are incorporated herein by reference.

Although the invention has been described above by reference to certain embodiments of the invention, the invention is not limited to the embodiments described above. Modifications and variations of the embodiments described above will occur to those skilled in the art in light of the above teachings. The scope of the invention is defined with reference to the following claims.

What is claimed is:

1. An intake manifold made of synthetic resin, comprising:

first, second and third members stacked in sequence and welded to form the intake manifold;

a collector extending inside the intake manifold in a direction of a line of cylinders, a part of wall of the collector being formed by the third member;

a plurality of branch passages formed substantially by the first and second members and wound around an outer periphery of the collector; and a connector passage leading from the collector to an outer peripheral side of a branch passage of the plurality of branch passages, wherein the first, second and third members are provided with first, second and third cylinder portions respectively, and the first, second and third cylinder portions are coaxially arranged with each other in a position between two adjacent branch passages of the plurality of branch passages, a first welding portion is formed in a boundary between the first and second members so as to encircle the first and second cylinder portions, a second welding portion is formed in a boundary between the second and third members so as to encircle the second and third cylinder portions, and the connector passage is formed by the first, second and third cylinder portions with the connector passage communicating with an inside space of the collector, wherein the first cylinder portion of the first member and the second cylinder portion of the second member, which form the connector passage, face each other through a gap, wherein a boundary between the first and second cylinder portions is sealed by the first welding portion so as to be encircled by the first welding portion, wherein the second cylinder portion of the second member and the third cylinder portion of the third member, which form the connector passage, face each other through a gap, and wherein a boundary between the second and third cylinder portions is sealed by the second welding portion so as to be encircled by the second welding portion.

2. The intake manifold as claimed in claim 1, wherein:

a part of the first welding portion located between the first and second members and encircling the first and second cylinder portions is formed by a branch passage-forming welding portion that is shaped along side edges of the two adjacent branch passages of the plurality of branch passages located at both sides of the first and second cylinder portions.

3. The intake manifold as claimed in claim 2, further comprising a mounting flange formed integrally with the third member.

4. The intake manifold as claimed in claim 1, wherein:

a boundary position between the first cylinder portion of the first member and the second cylinder portion of the second member is offset in an axial direction of the first and second cylinder portions from the first welding portion, and a space separates outer peripheral surfaces of the first and second cylinder portions from the first welding portion.

5. The intake manifold as claimed in claim 1, further comprising an inter-branch web between the two adjacent branch passages, wherein the first cylinder portion penetrates the inter-branch web.

* * * * *